US005142336A

United States Patent [19]

Hotomi et al.

[11] Patent Number: 5,142,336

[45] Date of Patent: Aug. 25, 1992

[54] DEVELOPER HAVING THE PREDETERMINED RESIDUAL POLARIZATION AND DEVELOPING APPARATUS FOR USING THE DEVELOPER

[75] Inventors: Hideo Hotomi; Yoshihisa Terasaka; Hiroshi Mizuno; Masahiro Anno, all of Osaka, Japan

[73] Assignee: Minolta Camera Kabushiki Kaisha, Osaka, Japan

[21] Appl. No.: 536,159

[22] Filed: Jun. 7, 1990

[30] Foreign Application Priority Data

Jun. 9, 1989 [JP] Japan ..... 1-147497

[51] Int. Cl.[5] ..... G03G 15/06

[52] U.S. Cl. ..... 355/261; 118/644; 355/246; 430/111

[58] Field of Search ..... 118/644, 654; 355/247, 355/249, 260, 261, 245, 246; 430/106.6, 111

[56] References Cited

U.S. PATENT DOCUMENTS 4,962,723 10/1990 Hotomi ..... 118/654
4,994,859 2/1991 Mizuno et al. ..... 355/247

FOREIGN PATENT DOCUMENTS 59-17559 1/1984 Japan .

*Primary Examiner*—A. T. Grimley
*Assistant Examiner*—P. Stanzione
*Attorney, Agent, or Firm*—Burns, Doane, Swecker & Mathis

[57] ABSTRACT

A developing apparatus includes: an electrostatic latent image holding member for holding an electrostatic latent image; an accommodating device for accommodating therein developer of residual polarization of 0.1-20 $\mu C/cm^2$; an electric field developing device arranged in the accomodating device, the developer being polarized by action of an electric field force developed by the electric field developing device; and a transporting device for transporting the polarized developer too the holding member to develop the electrostatic latent image on the holding member by the developoer. An unequal alternating electric field is able to be developed by the electric field developing device to apply the electric field curtain force on the developer. The electric field developing device comprises at least two electrodes electrically insulated from each other and an applying device for applying an alternating voltage on the two electrodes. An alternating voltage with a peak-to-peak voltage of 200V-6KV and a frequency of tens -tens KHz is applied on the electrodes by the applying device. The developer comprises ferroelectric powder and organic binder. The developer has an average grain diameter of 2-20 μm. The powder has an average grain diameter of 0.02-5.0 μm and the developer comprises 0.1-50 wt% of the powder.

9 Claims, 5 Drawing Sheets

DEVELOPER HAVING THE PREDETERMINED RESIDUAL POLARIZATION AND DEVELOPING APPARATUS FOR USING THE DEVELOPER

BACKGROUND OF THE INVENTION

The present invention relates to a developing apparatus for employing in an electrophotographic apparatus, and more particularly, to a developing apparatus for transporting charged toner by action of an electric field curtain.

Recently, as described in Japanese Laid-open Patent Publication No. 47-47811, Japanese Laid-open Patent Publication No. 59-181371, Japanese Laid-open Patent Publication No. 59-189367, and Japanese Laid-open Patent Publication No. 63-13068, there each have been proposed a developing apparatus for employing in an electrophotographic apparatus in which an electric field curtain developing device is arranged and toner is transported by action of the electric field curtain force to be supplied onto an image-holding member such as a photosensitive drum.

In the apparatus for employing the curtain developing device, however, unless toner is electrically charged ahead of time, the toner cannot be sufficiently and electrically charged and transported by the electric field curtain force. Therefore, the toner can not be promptly and electrically charged, which causes the toner to be scattered and any fog occurs on a copy paper by any poorly charged toner.

SUMMARY OF THE INVENTION

The object of the present invention is to remedy the above-described disadvantages caused in a case where toner is electrically charged and transported by an electric field curtain developing device in a developing apparatus for employing in an electrophotographic apparatus.

That is, the object of the present invention is to improve toner charge starting speed, ensure that toner is electrically charged in an adequate charge amount, prevent toner from being scattered and any fog from occurring in an image, and obtain a stable and high-quality image for long time.

According to a preferred embodiment of the present invention, in a developing apparatus comprising an electric field curtain developing device for transporting developer, toner with 0.1-20$\mu$C/cm$^2$ residual polarization is used as that in the developer.

The toner with 0.1-20$\mu$C/cm$^2$ residual polarization which is produced by such a process that ferroelectric fine powder is dispensed in the inside of toner or the powder is adhered to the surface of toner can be used therein.

The developer according to another embodiment of the present invention has the average grain diameter of 2-20$\mu$m, preferably 4-15$\mu$m. The unequal electric fields for the developer is appropriately employed as described below. That is, for example, when a space between electrodes is set to 1 mm width, an alternating voltage for applying on the developer or a peak-to-peak triangular-wave voltage appropriately is 200V-6KV, i.e., 2000V/cm-60KV/cm, preferably 200V-2KV, i.e., 2000V/cm-20KV/cm. When a voltage of not less than 6KV is applied thereon, electrical discharge may be easily induced even though the surface of the electrode is covered with an adequate electrical insulating material. In that case, the frequency thereof preferably is tens-ten KHz. The frequency not more than 10Hz easily causes irregular oscillation, while the frequency more than 10KHz easily causes irregular oscillation because any resonance of the apparatus no more is disregarded.

One or a solid solution fine powder of Barium titanate, lead titanate, strontium titanate, lithium titanate, potassium titanate, bismuth titanate, calcium titanate, lithium niobate, potassium niobate, sodium niobate, lithium tantalate, lead zirconate, barium zirconate, barium stannate, PZT (comprising Pb, Zr, and Ti), PLZ (comprising Pb, La, and Zr), or PLZT (lanthanum substituted lead titanite zirconate) can be employed as the ferroelectric fine powder for adding to the toner.

It is suitable to use the above-described ferroelectric fine powder with the average grain diameter of normally 0.02-5.0$\mu$m, preferably not more than 1.0$\mu$m, for adding the powder to the toner.

The fine powder of 0.1-50 wt % is normally added to the toner so that the residual polarization of the toner is 0.1-20$\mu$C/cm$^2$.

The reason why the residual polarization of the toner is 0.1-20$\mu$C/cm$^2$ is that the residual polarization not more than 0.1$\mu$C/cm$^2$ causes the toner to be insufficiently polarized by an electric field not to enable the toner to be sufficiently charged, while the residual polarization not less than 20$\mu$C/cm$^2$ easily causes the toner to agglomerate with each other. Thus, it is difficult for the developer to be subject to an alternating electric field or be electrically charged without nonuniformity. Additionally, when the ferroelectric fine powder is added to the toner as described above so that the toner can have the residual polarization of not less than 20$\mu$C/cm$^2$, the adding amount of the fine powder excessively increases, so that the characteristic of the toner deteriorates and the electric charge amount of the toner excessively increases to deteriorate the characteristic of the development.

Furthermore, in the developing apparatus, in order to more promptly start the electric charging operation of the toner, an electrically charging device for electrically charging the toner ahead of time can be arranged in the apparatus.

According to the construction of the embodiments of the present invention, when the developer is transported by an electric field curtain force developed by an electric field curtain developing device, the toner, in the developer, with the residual polarization of 0.1-20$\mu$C/cm$^2$ is employed. Thus, by the action of the electric field curtain force, the toner is electrically and instantly charged and brings about a trigger action. Then, the action of the electric field curtain force promptly causes the toner, which is to be transported, to be electrically charged in an adequate and uniform charge amount.

As a result thereof, in a case where the apparatus according to the embodiments of the present invention is employed, the whole toner is promptly and electrically charged in an adequate and uniform charge amount to increase response of the apparatus and prevent any fog from occurring on an image and any toner from being scattered. Additionally, it can prevent toner deterioration caused by electrical discharge and mechanic contact, resulting in obtaining an image with stable and high quality for long time.

BRIEF DESCRIPTION OF THE DRAWINGS

These and other objects and features of the present invention will become clear from the following description taken in conjunction with the preferred embodiments thereof with reference to the accompanying drawings.

DETAILED DESCRIPTION OF THE INVENTION

Figure 1:
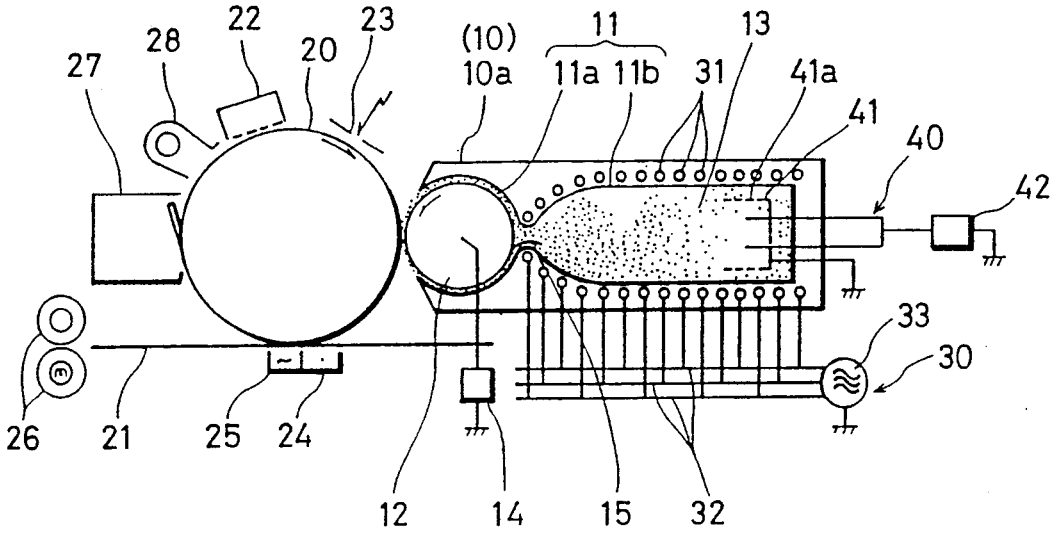
FIG. 1 is a schematically cross sectional view of a developing apparatus according to a first embodiment of the present invention in a state where the apparatus is being employed.

Before the description of the present invention proceeds, it is to be noted that like parts are designated by like reference numerals throughout the accompanying drawings.

First embodiment

In a developing apparatus 10*a* according to the first embodiment, toner 13*a* having residual polarization of 0.1–20$\mu$C/cm$^2$ is employed as developer 13.

The apparatus 10*a* has a body 11 made of electrical insulating material such as polycarbonate, as shown in FIG. 1. The body 11 has an electric field curtain developing device 30 at a developer accommodating section 11*b* for accommodating the developer 13. By the action of the electric field curtain force developed by the developing device 30, the developer 13 accommodated in the section 11*b* is supplied to a developing sleeve 12 located in a developer transporting section 11*a* so as to be transported to a photosensitive member 20 by the sleeve 12.

The developing device 30 is so constructed that three three-layer wounded conducting coils 31 made of conducting material such as copper, aluminum, steel, nickel, zinc, or gold are arranged in a wall of the developer accommodating section 11*b* and are connected to a three-phase alternating power source 33 by leads 32.

Alternating voltages with different phase from each neighboring phase are applied from the power source 33 to each coil 31 through each lead 32 to form rows of traveling-wave unequal alternating electric fields in the developer accommodating section 11*b*.

Hereinbelow, the electric field curtain is described.

Figure 2:
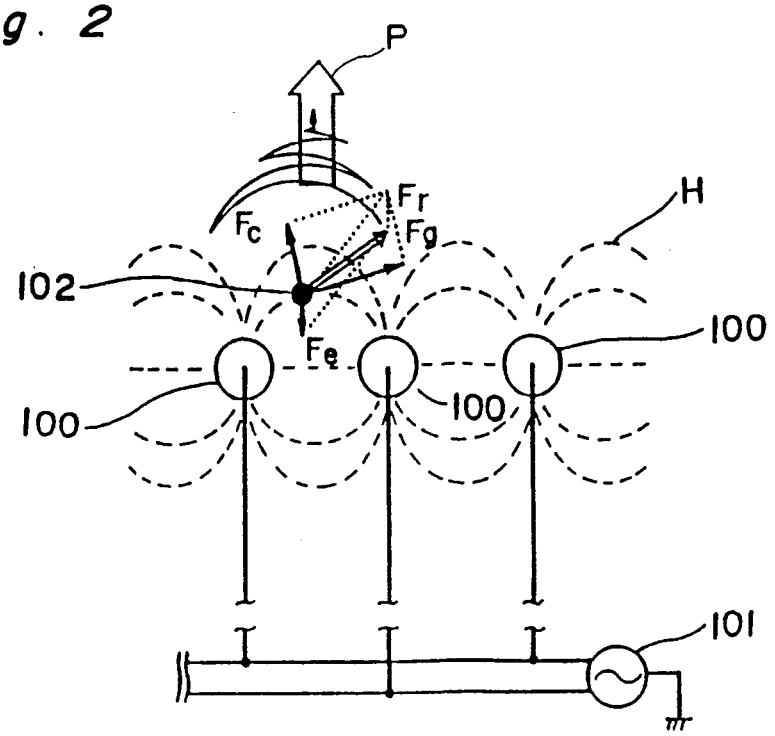
FIG. 2 is a schematic diagram showing how an electric field curtain force is developed.

Referring to FIG. 2, if two electrodes generally identified by 100 are connected to an alternating power source 101, an alternating electric field is developed between the electrodes 100 and in the vicinity thereof as indicated by H and, therefore, all of three forces, i.e., a gradient force Fg parallel to the gradient of the electric field, a centrifugal force Fc acting perpendicular to the gradient force Fg in a direction away from the common plane passing through the electrodes 100, a centrifugal force Fc acting in a direction away from an external plane, and an external force Fe (such as resulting from the gravitational force and/or the force induced by a wind blow) act at a certain moment on an electrically charged particle 102 situated between the electrodes 100. Assuming that the external force Fe is small, the cumulative force Fr equal to the sum of the gradient and centrifugal forces Fg and Fc acts in such a direction that the electrically charged particle 102 may be expelled away from the electrodes 100.

Since the direction of the lines of electric force varies in time and space with the applied alternating voltage (which is so-called unequal alternating electric field), the electrically charged particle 100 undergoes a generally zig-zag motion in dependence on the frequency of the alternating voltage and is finally expelled in a direction shown by the arrow P under the influence of Coulomb force of repulsion (which force is called the electric field curtain force). The magnitude of the electric field curtain force is related with the amount of electric charge born by the electrically charged particle 102.

Within the developer accommodating section 11*b* in which the developer 13 is accommodated, a corona discharge device 41, serving as an electrically charging device 40, is arranged at the rear position away from the sleeve 12. The corona discharge device 41 has a mesh-like skirt 41*a*. A voltage for electrically charging is applied from an electric source 42 for electrically charging to the corona discharge device 41.

The polarity of the voltage of the electrical charge applied from the electric source 42 to the corona discharge device 41 corresponds to the polarity of the electrically charged voltage of the developer 13 accommodated in the developer accommodating section 11*b*. A positive voltage is applied to the developer capable of being positively and electrically charged. A negative voltage is applied to the developer capable of being negatively and electrically charged.

Figure 3:
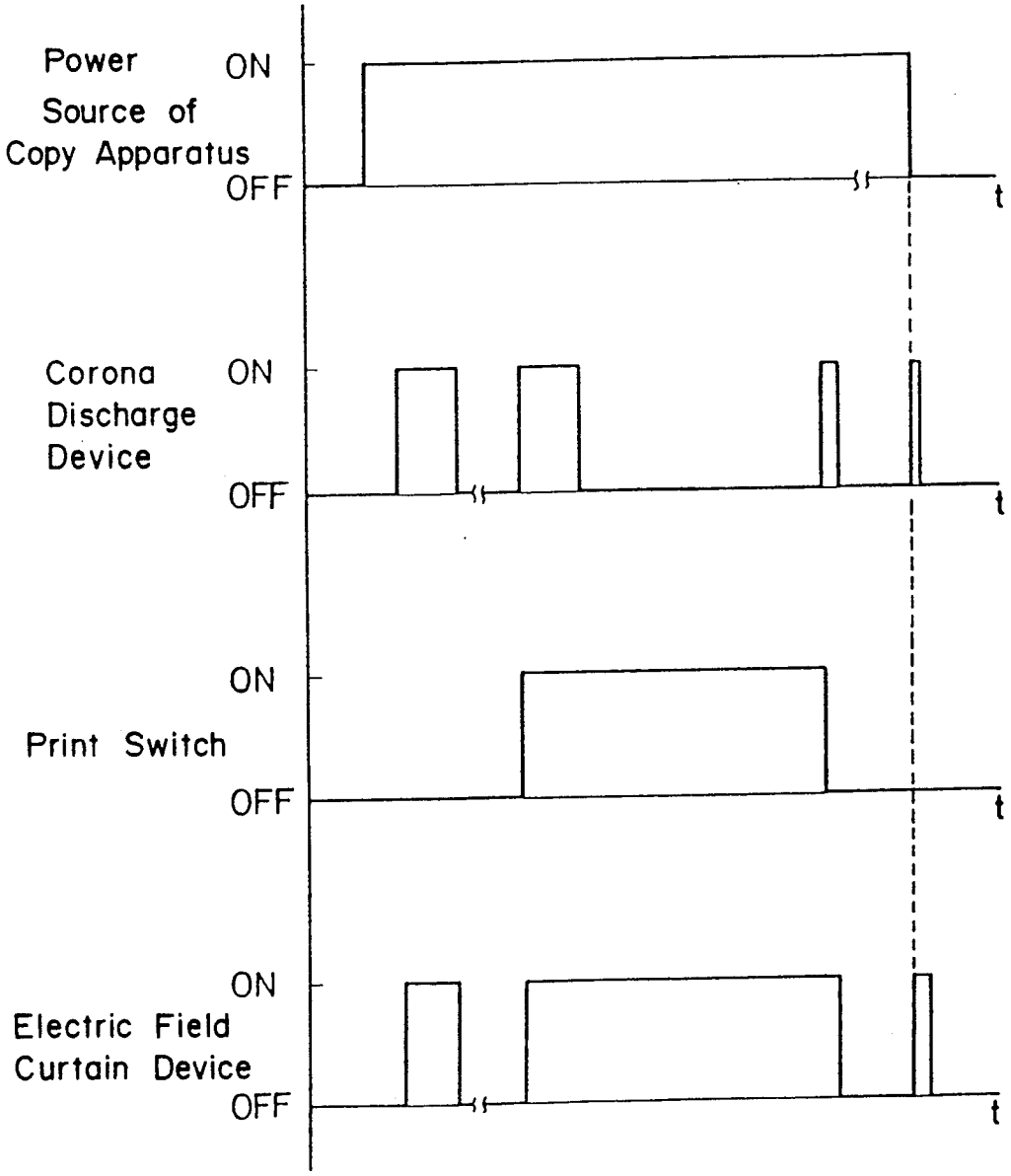
FIG. 3 is a timing chart showing the state where the apparatus is being employed.

In a copy apparatus employing the developing apparatus 10*a*, the developer 13 is supplied from the developing apparatus 10*a* to the surface of the photosensitive member 20 to form an image on a copy paper 21. The copying operation is described hereinbelow, referring to FIGS. 1 and 3.

Firstly, on turning-on a power source of the copy apparatus, a voltage for electrically charging is applied from the electric source 42 to the corona discharge device 41 in a specified period and then the developer 13 accommodated in the developer accommodating section 11*b* is electrically charged by the corona discharge device 41. Alternating voltages with different phases from each other are applied from the power source 33 to each coil 31 to act the electric field curtain force, so that the developer 13 previously accommodated in the developer accommodating section 11*b* is electrically charged and stirred.

On turning-on a print start switch, a voltage for electrically charging is simultaneously applied from the electric source 42 to the corona discharge device 41 in a specified period, so that the developer 13 previously accommodated in the developer accommodating section 11*b* is electrically charged by the corona discharge device 41 and alternating voltages with different phase from each other are applied from the power source 33 to each coil 31 to act the electric field curtain force on the developer 13.

In this way, the developer 13 electrically charged by the corona discharge device 41 brings about a trigger action by the charge and the developer 13 is electrically charged while the developer 13 has residual polarization by the action of the electric field curtain force. Thus, the developer 13 is uniformly and promptly charged in an adequate charge amount. Then, the developer 13 is sequentially transported toward the sleeve 12 by the action of the electric field curtain force to be supplied to the sleeve 12. The developer 13 is further transported toward the photosensitive member 20 by the rotation of the sleeve 12.

On the other hand, after the surface of the member 20 to which the developer 13 electrically charged in this way is suppled is electrically charged by a electric charger 22, a light beam is projected on the electrically charged surface of the member 20 through a slit 23 to form an electrostatic latent image on the surface of the member 20.

In the developing apparatus 10*a*, a developing bias voltage 14 is applied to the sleeve 12 to which the developer 13 has been supplied, and then the developer 13 is supplied from the sleeve 12 to a portion formed the latent image on the surface of the member 20 to form a toner image on the surface of the member 20.

Next, the toner image formed on the surface thereof is transferred onto the paper 21 through a transfer charger 24 and an erasing charger 25 for removing the charge from the surface thereof. The transferred toner image is fixed to the paper 21 by a fixing roller 26. The developer 13 left on the surface of the member 20 is removed from the surface thereof by a cleaning unit 27 and then the surface of the member 20 is neutralized by an eraser 28.

The developer 13 left on the surface of the sleeve 12 without being supplied to the member 20 is scraped and introduced into the developer accommodating section 11*b* by a scraper 15.

After the copying operation, when the print start switch is turned off, the corona discharge device 41 and the developing device 30 are preferably driven a moment to electrically charge and mix the developer 13 in the developer accommodating section 11*b* to be uniform. Similarly, when the power switch of the copy apparatus is turned off, the corona discharge device 41 and the developing device 30 are preferably driven a moment to electrically charge and mix the developer 13 in the developer accommodating section 11*b* to be uniform.

Second embodiment

In a developing apparatus 10*b* according to the second embodiment, the toner 13*a* having residual polarization of 0.1-20$\mu$C/cm$^2$ similarly to that of the first embodiment is employed as the developer 13.

Figure 4:
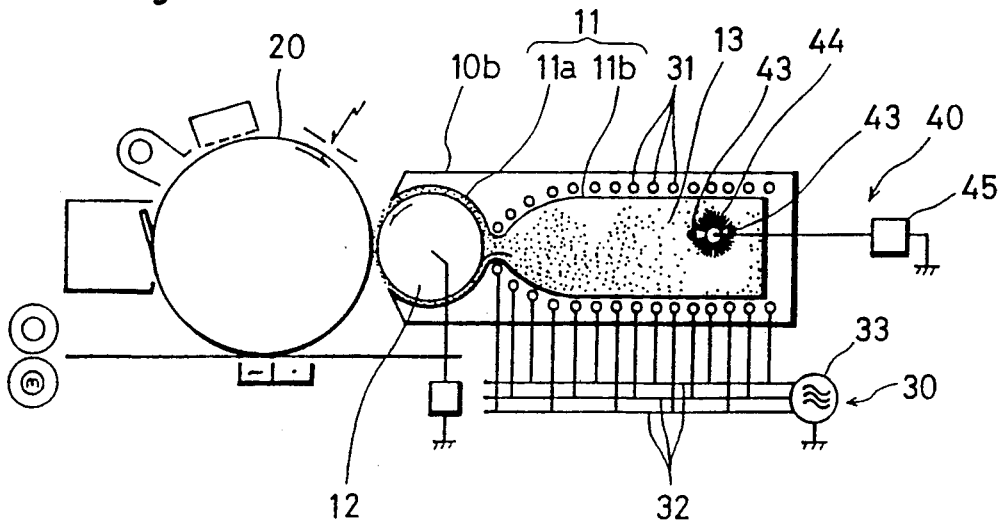
FIG. 4 is a schematically cross sectional view of a developing apparatus according to a second embodiment of the present invention in a state where the apparatus is being employed.

As shown in FIG. 4, the construction of the apparatus 10*b* is approximately similar to that of the apparatus 10*a* according to the first embodiment. The developing device 30 is arranged at the developer accommodating section 11*b* for accommodating the developer 13. In the developer accommodating section 11*b*, the charging device 40 for electrically charging the developer 13 accommodated in the developer accommodating section 11*b* is arranged at a position away from the sleeve 12.

In the apparatus 10*b*, a conducting brush 44, serving as the charging device 40, is arranged in the developer accommodating section 11*b*.The brush 44 rotates while contacting with a contact member 43 such as a rubbing bar or a wire. A bias voltage is applied from a bias electric source 45 to the brush 44 and electrical discharge is induced between the brush 44 and the contact member 43 to electrically charge the developer 13 accommodated in the developer accommodating section 11*b*.

The polarity of the bias voltage applied from the bias electric source 45 to the brush 44 corresponds to the polarity of the electrically charged voltage of the developer 13 accommodated in the developer accommodating section 11*b*. A positive voltage is applied to the developer capable of being positively and electrically charged. A negative voltage is applied to the developer capable of being negatively and electrically charged.

Instead of the brush 44, a brush made of electrical insulating material can be employed. The material such as Tefron (which is the trademark for polytetrafluoroethylene) or glass fiber which has high electric charge order is preferably employed as the electrical insulating material.

Third embodiment

In a developing apparatus 10*c* according to the third embodiment, two-component system developer comprising the toner 13*a* having residual polarization of 0.1-20$\mu$C/cm$^2$ similarly to that of each of the first and second embodiments and a carrier 13*b* is employed as the developer 13.

Figure 5:
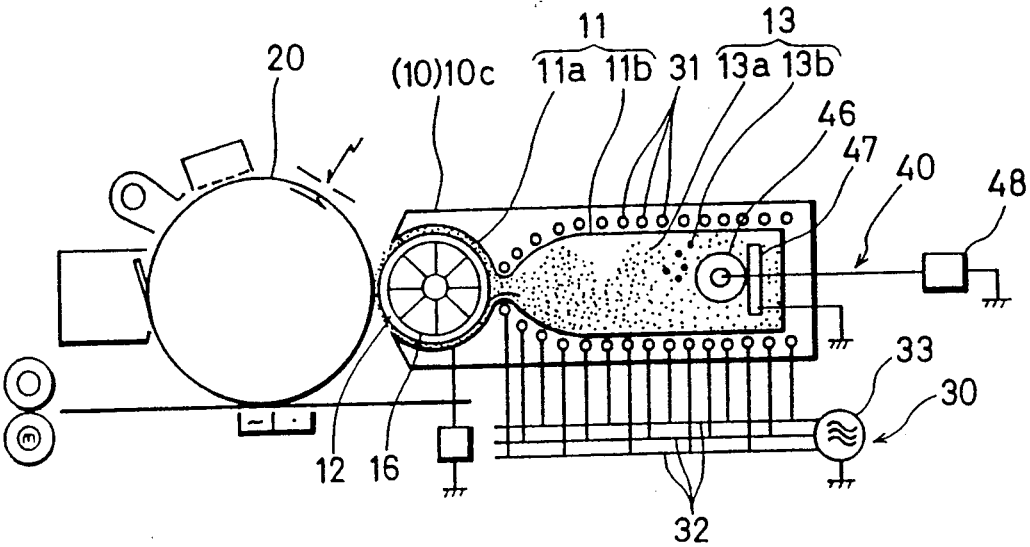
FIG. 5 is a schematically cross sectional view of a developing apparatus according to a third embodiment of the present invention in a state where the apparatus is being employed.

As shown in FIG. 5, the construction of the apparatus 10*c* is approximately similar to each construction of the apparatuses 10*a* and 10*b* according to the first and second embodiments. The curtain developing device 30 is arranged at the developer accommodating section 11*b* for accommodating the developer 13. In the developer accommodating section 11*b*, the charging device 40 for electrically charging the developer 13 accommodated in the developer accommodating section 11*b* is arranged at a position away from the sleeve 12.

In the apparatus 10*c*, a conducting rubber roller 46 with fine irregularities on the surface thereof is arranged, serving as the charging device 40, in the developer accommodating section 11*b*. The roller 46 rotates while contacting with a metal plate 47 made of metal such as aluminum, stainless steel, steel, gold, chrome, nickel, or copper. A bias voltage is applied from a bias electric source 48 to the roller 46, so that electrical discharge is induced between the roller 46 and the plate 47 to electrically charge the developer 13 accommodated in the developer accommodating section 11*b*.

The polarity of the bias voltage applied from the bias electric source 48 to the roller 46 corresponds to the polarity of the electrically charged voltage of the toner 13*a* accommodated in the developer accommodating section 11*b*. A positive voltage is applied to the toner 13*a* capable of being positively and electrically charged. A negative voltage is applied to the toner 13*a* capable of being negatively and electrically charged.

In order to transport the two-component system developer 13 comprising the toner 13*a* and the carrier 13*b* as described above by the sleeve 12, magnet rollers 16 are arranged in the sleeve 12. Then, the developer 13 is transported on the sleeve 12 in a magnetic brush state.

Fourth embodiment

Figure 6:
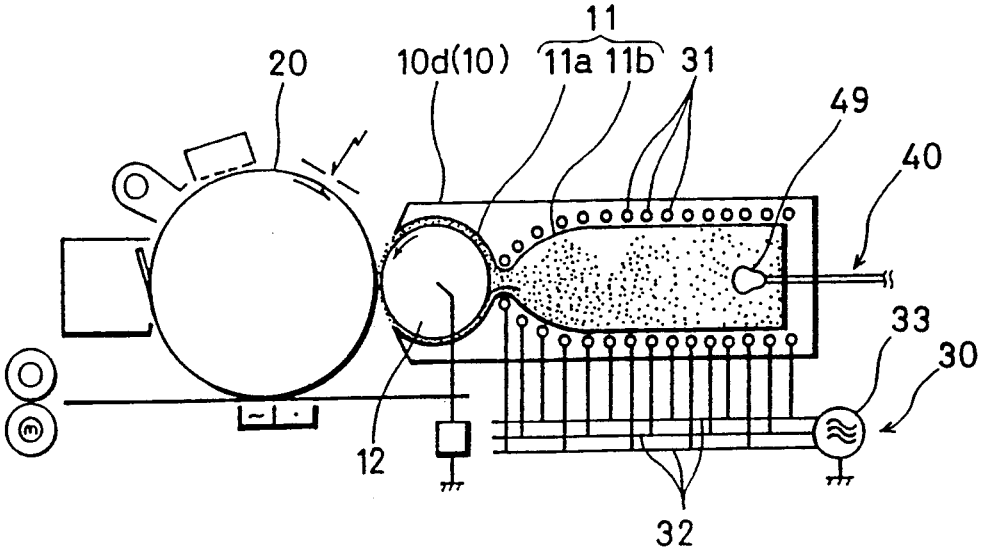
FIG. 6 is a schematically cross sectional view of a developing apparatus according to a fourth embodiment of the present invention in a state where the apparatus is being employed.

As shown in FIG. 6, the construction of a developing apparatus 10*d* according to the fourth embodiment is approximately similar to each construction of the apparatuses 10*a*, 10*b*, and 10*c* according to the first, second, and third embodiments. The developing device 30 is arranged at the developer accommodating section 11*b* for accommodating the developer 13. In the developer accommodating section 11*b*, the charging device 40 for electrically charging the developer 13 accommodated in the developer accommodating section 11*b* is arranged at a position away from the sleeve 12.

In the apparatus 10*d*, an electron beam tube 49 is arranged in the developer accommodating section 11*b* as the charging device 40 to give an electron to the developer 13 accommodated in the developer accommodating section 11*b*.

Then, in the apparatus 10*d*, the toner 13*a*, preferably toner capable of being negatively charged, having residual polarization of 0.1-20$\mu$C/cm$^2$ is employed as the developer 13, similarly to each embodiment.

Fifth embodiment

In a developing apparatus 10*e* according to the fifth embodiment, two-component system developer comprising the toner 13*a* having residual polarization of 0.1-20$\mu$C/cm$^2$ similarly to that of the third embodiment and a carrier 13*b* is employed as the developer 13.

Figure 7:
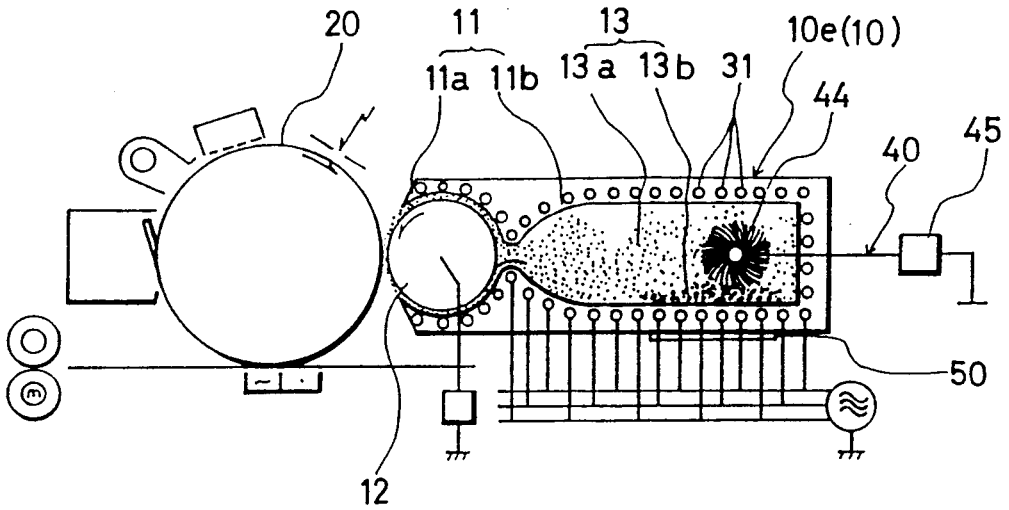
FIG. 7 is a schematically cross sectional view of a developing apparatus according to a fifth embodiment of the present invention in a state where the apparatus is being employed.

As shown in FIG. 7, the developing devices 30 are arranged at the developer accommodating section 11*b* for accommodating the developer 13, similarly to that of each apparatus according to each embodiment described above, and in the developer transporting section 11*a* in which the sleeve 12 for transporting the developer 13 is accommodated.

In the developer accommodating section 11*b*, the conducting brush 44 serving as the charging device 40 for electrically charging the developer 13 accommodated in the developer accommodating section 11*b* is rotatably arranged. A bias voltage is applied from the bias electric source 45 to the brush 44. A magnet 50 is arranged below the developer accommodating section 11*b*. The carrier 13*b* in the developer 13 is held at the bottom of the developer accommodating section 11*b* to prevent it from scattering.

By the action of the electric field curtain force developed by the curtain developing device 30 arranged in the developer accommodating section 11*b*, the carrier 13*b* held at the bottom of the developer accommodating section 11*b* by the magnet 50 is oscillated. Then, the toner 13*a* is electrically charged by contacting with the oscillating carrier 13*b* and is further electrically charged by inducing electrical discharge between the brush 44 and the carrier 13*b* in response to the rotation of the brush 44.

Sixth embodiment

In a developing apparatus 10*f* according to the sixth embodiment the toner 13*a* having residual polarization of 0.1-20$\mu$C/cm$^2$ is employed as the developer 13.

Figure 8:
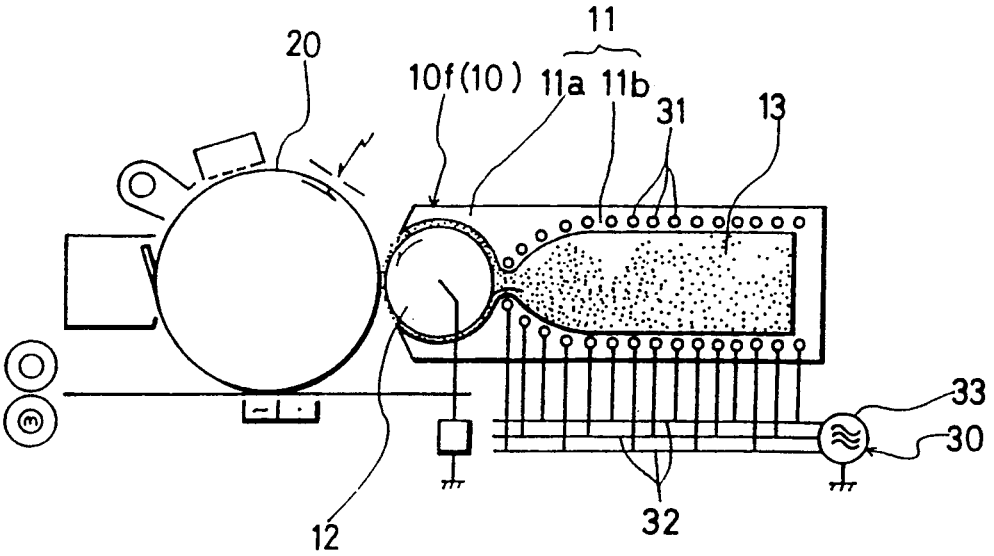
FIG. 8 is a schematically cross sectional view of a developing apparatus according to a sixth embodiment of the present invention in a state where the apparatus is being employed.

As shown in FIG. 8, the curtain developing device 30 is arranged at the developer accommodating section 11*b* for accommodating the developer 13, similarly to that of each apparatus according to each embodiment described above.

The apparatus 10*f* does not comprise the above-described charging device 40 for forcedly charging the developer 13, as shown in FIG. 8. In order to electrically charge the developer 13 accommodated in the developer accommodating section 11*b*, the action of the electric field curtain force developed by the curtain developing device 30 causes the developer 13 to induce residual polarization to electrically charge.

The developing apparatus 10 employing in the present invention is not limited to those of the first through sixth embodiments. For example, the developing device 30 is not arranged in the body 11, that is, in the developer accommodating section 11*b* or the developer transporting section 11*a*. Instead, the developing device 30 may be arranged on the sleeve 12 for transporting the developer 13 accommodated in the developer transporting section 11*a*, but the arrangement is not shown in the drawings.

Next, the apparatuses 10 according to the first, second, fourth, fifth, and sixth embodiments are employed as test examples 1-7, and toner $T_1$-$T_4$ described below is employed as the toner 13*a* in the developer 13 for development.

(Toner $T_1$)

In the toner $T_1$, after 95 parts by weight of paraffin wax (first grade reagent, softening point: 80° C.) is mixed and stirred with 5 parts by weight of carbon black MA8 (manufactured by Mitsubishi Chemical Industries Limited) by a ball mill, the mixed and stirred material is kneaded in 5 minutes by using three rollers while the material is heated at 100° C., and then the material is left to cool. Then, the material is coarsely crushed by a hammer mill and is finely ground by a jet grinder while the material is cooled by liquid nitrogen. Thereafter, the fine ground material is classified to obtain non-magnetic toner $t_1$ with the grain diameter of 2-15$\mu$m and the average grain diameter of 9$\mu$m.

Forty parts by weight of barium titanate (the average grain diameter: 0.5$\mu$m) as ferroelectric fine powder is added to 957 parts by weight of the non-magnetic toner $t_1$ and they are introduced in a mixer to be sufficiently mixed. Thereafter, the introduced material is heated by hot air of 100° C. in a spray dryer to fix the barium titanate on the surface of the non-magnetic toner $t_1$.

Three parts by weight of hydrophobic silica R-972 (manufactured by Nippon Aerosil Co., Ltd.) is added to 997 parts by weight of the toner $t_1$ of which barium titanate is fixed on the surface. Then, they are introduced in the mixer to be sufficiently mixed and stirred to attach the silica to the toner, resulting in preparing the toner $T_1$ with residual polarization of approximately 0.46$\mu$C/cm$^2$.

(Toner $T_2$)

In the toner $T_2$, instead of fine powder of barium titanate employed in the toner $T_1$ as ferroelectric fine powder, fine powder of lithium niobate solid solution is employed. Another component except for the powder and the preparing process are the same as the toner $T_1$, resulting in preparing the toner $T_2$ with residual polarization of approximately $0.39\mu C/cm^2$.

(Toner $T_3$)

In the toner $T_3$, PLZT, which has composition ratio of $(Pb_{1-x}\ Lax)/(Zry\ Tiz)/O_3$=PLZT (x/y/z)=(0.07/0.65/0.35), with the average grain diameter of 0.5μm is employed as ferroelectric fine powder. After 60 parts by weight of the PLZT is added to 40 parts by weight of paraffin wax (first grade reagent, softening point: 80° C.) and 5 parts by weight of carbon black MA8 (manufactured by Mitsubishi Chemical Industries Limited), they are mixed and stirred by a ball mill. Thereafter, the mixed and stirred material is kneaded in 5 minutes by using three rollers while the material is heated at 100° C., and then the material is left to cool. Then, the material is coarsely crushed by a hammer mill and is finely ground by a jet grinder. Then, the fine ground material is classified to obtain non-magnetic toner $t_3$ with the grain diameter of 2–16μm and the average grain diameter of 10μm.

Three parts by weight of hydrophobic silica R-927 manufactured by Nippon Aerosil Co., Ltd.) is added to 997 parts by weight of the toner $t_3$. Then, they are introduced in a mixer to be sufficiently mixed and stirred to attach the silica to the toner, resulting in preparing the toner $T_3$ with residual polarization of approximately $2.1\mu C/cm^2$.

(Toner $T_4$)

In the toner $T_4$, instead of fine powder of PLZT employed in the toner $T_3$ as ferroelectric fine powder, fine powder of barium stannate is employed. Another component except for the powder and the preparing process are the same as the toner $T_3$, resulting in preparing the toner $T_4$ with residual polarization of approximately $0.50\mu C/cm^2$.

(TEST EXAMPLE 1)

In the test example 1, the developing apparatus 10*a* according to the first embodiment shown in FIG. 1 is employed as the developing apparatus 10. The toner $T_1$ is employed as the developer 13.

In the apparatus 10*a*, d.c. voltage of +5KV is applied from the electric source 42 to the corona discharge device 41 arranged in the developer accommodating section 11*b* to induce electrical discharge. Alternating voltage having a frequency of 300Hz and phases each shifted by peak-to-peak voltage $V_{p-p}$ of 900V is applied from the power source 33 with $\frac{2}{3}\pi$ radians in phase difference each between neighboring phases to each coil 31 to act an electric field curtain force on the toner. The action of the electric field curtain force causes the toner $T_1$ to be electrically charged and be supplied on the surface of the sleeve 12. Then, the toner $T_1$ is transported toward the photosensitive member 20 through the sleeve 12 to develop an image.

(TEST EXAMPLE 2)

In the test example 2, the developing apparatus 10*a* according to the first embodiment shown in FIG. 1 is employed as the developing apparatus 10, similarly to the test example 1. The toner $T_2$ is employed as the developer 13.

In the apparatus 10*a*, d.c. voltage of −5.0KV is applied from the electric source 42 to the corona discharge device 41 arranged in the developer accommodating section 11*b* to induce electrical discharge. An alternating voltage having a frequency of 300Hz and phases each shifted by peak-to-peak voltage $V_{p-p}$ of 1100V is applied from the power source 33 with $\frac{2}{3}\pi$ radians in phase difference each between neighboring phases to each coil 31 to act an electric field curtain force on the toner. The action of the electric field curtain force causes the toner $T_2$ to be electrically charged and be supplied on the surface of the sleeve 12. Then, the toner $T_2$ is transported toward the photosensitive member 20 through the sleeve 12 to develop an image.

(TEST EXAMPLE 3)

In the test example 3, the developing apparatus 10*b* according to the second embodiment shown in FIG. 4 is employed as the developing apparatus 10. The toner $T_3$ is employed as the developer 13.

In the apparatus 10*b*, the brush 44 arranged in the developer accommodating section 11*b* is rotated at 80 rpm. Thus, d.c. voltage of +500V is applied from the bias electric source 45 to the brush 44 to induce electrical discharge between the brush 44 and the contact member 43. An alternating voltage having a frequency of 1500Hz and phases each shifted by peak-to-peak voltage. $V_{p-p}$ of 950V is applied from the power source 33 to each coil 31 to act an electric field curtain force on the toner. The action of the electric field curtain force causes the toner $T_3$ to be electrically charged and be supplied on the surface of the sleeve 12. Then, the toner $T_3$ is transported toward the photosensitive member 20 through the sleeve 12 to develop an image.

(TEST EXAMPLE 4)

In the test example 4, the developing apparatus 10*b* according to the second embodiment shown in FIG. 4 is employed as the developing apparatus 10, similarly to the test example 3. The toner $T_1$ is employed as the developer 13.

In the apparatus 10*b*, the brush 44 arranged in the developer accommodating section 11*b* is rotated at 80 rpm. Thus, d.c. voltage of −800V is applied from the bias electric source 45 to the brush 44 to induce electrical discharge between the brush 44 and the contact member 43. An alternating voltage having a frequency of 500 Hz and phases each shifted by peak-to-peak voltage $V_{p-p}$ of 850 V is applied from the power source 33 to each coil 31 to act an electric field curtain force on the toner. The action of the electric field curtain force causes the toner $T_1$ to be electrically charged and be supplied on the surface of the sleeve 12. Then, the toner $T_1$ is transported toward the photosensitive member 20 through the sleeve 12 to develop an image.

(TEST EXAMPLE 5)

In the test example 5, the developing apparatus 10*d* according to the fourth embodiment shown in FIG. 6 is employed as the developing apparatus 10. The toner $T_4$ is employed as the developer 13.

In the apparatus 10*d*, a voltage is applied to the tube 49 arranged in the developer accommodating section 11*b*, so that an electron is given to the toner $T_4$ and an alternating voltage having a frequency of 800Hz and phases each shifted by peak-to-peak voltage $V_{p-p}$ of 1000 V is applied from the power source 33 to each coil 31 to act an electric field curtain force on the toner. The action of the electric field curtain force causes the toner $T_4$ to be electrically charged and be supplied on the surface of the sleeve 12. Then, the toner $T_4$ is transported toward the photosensitive member 20 through the sleeve 12 to develop an image.

(TEST EXAMPLE 6)

In the test example 6, the developing apparatus 10*e* according to the fifth embodiment shown in FIG. 7 is employed as the developing apparatus 10. Two-component system developer comprising the toner $T_2$ and carrier described hereinbelow is employed as the developer 13.

The carrier is so consisted as described hereinbelow. 100 parts by weight of polyester resin (softening point: 123° C., glass point: 65° C., acid value 23, OH value 40), 500 parts by weight of inorganic magnetic powder EPT-1000 (manufactured by Toda Industrial Co., Ltd.), and 2 parts by weight of carbon black MA#8 (manufactured by Mitsubishi Chemical Industries Limited) are sufficiently mixed and crushed by a Henschel mixer. Then, the mixed and crushed material is fused and kneaded by an extruding kneader in which the cylinder section is heated at 180° C. and the cylinder head is heated at 170° C., and then the kneaded material is cooled. Thereafter, the material is finely ground by a jet mill and then is classified by a classifier, resulting in preparing the magnetic carrier with the average grain diameter of 55μm.

In the apparatus 10*d*, the brush 44 arranged in the developer accommodating section 11*b* is rotated at 25 rpm. Thus, d.c. voltage of +450V is applied from the bias electric source 45 to the brush 44 to induce electrical discharge between the brush 44 and the magnetic carrier which is described above held at the bottom of the developer accommodating section 11*b* by the magnet 50 arranged below the developer accommodating section 11*b*. An alternating voltage having a frequency of 200Hz and phases each shifted by peak-to-peak voltage $V_{p-p}$ of 1.3KV is applied from the power source 33 to each coil 31 to act an electric field curtain force on the toner. The action of the electric field curtain force causes the toner $T_2$ to be electrically charged and be supplied on the surface of the sleeve 12. Then, the toner $T_2$ is transported toward the photosensitive member 20 through the sleeve 12 to develop an image.

(TEST EXAMPLE 7)

In the test example 7, the developing apparatus 10*f* according to the sixth embodiment shown in FIG. 8 is employed as the developing apparatus 10. The toner $T_3$ is employed as the developer 13.

In the apparatus 10*f*, an alternating voltage having a frequency of 600 Hz and phases each shifted by peak-to-peak voltage $V_{p-p}$ of 950V is applied from the power source 33 to each coil 31 arranged at the developer accommodating section 11*b* to act an electric field curtain force on the toner. The action of the electric field curtain force causes the toner $T_3$ to be electrically charged by polarizing and be supplied on the surface of the sleeve 12. Then, the toner $T_3$ is transported toward the photosensitive member 20 through the sleeve 12 to develop an image.

Next, in order to compare with the test examples 1–7, toner $T_5$ and $T_6$ which have substantially no residual polarization, which is described hereinbelow, is employed as the toner in the developer in comparative examples 1–3.

(Toner $T_5$)

In order to prepare the toner $T_5$, the process for adding the fine powder of barium titanate serving as the ferroelectric fine powder is omitted in preparing the toner $T_1$, and another processes are performed similarly to those of the toner $T_1$ for preparation, resulting in obtaining the toner $T_5$ with residual polarization of $0.04\mu C/cm^2$ and without ferroelectric fine powder.

(Toner $T_6$)

The toner $T_6$ is so consisted as described hereinbelow. After 95 parts by weight of paraffin wax (first grade reagent, softening point: 80° C.) is mixed and stirred with 5 parts by weight of carbon black MA8 (manufactured by Mitsubishi Chemical Industries Limited) by a ball mill, the mixed and stirred material is kneaded in 5 minutes by using three rollers while the material is heated at 100° C., and then the material is left to cool. Then, the material is coarsely crushed by a hammer mill and is finely and gradually ground for long periods while forcedly cooled by liquid nitrogen. Then, the fine ground material is classified to obtain non-magnetic toner $t_6$ with the grain diameter of 2–16μm and the average grain diameter of 10μm.

Three parts by weight of hydrophobic silica R-927 (manufactured by Nippon Aerosil Co., Ltd.) is added to 997 parts by weight of the toner $t_6$. Then, they are introduced in a mixer to be sufficiently mixed and stirred to attach the silica to the toner, resulting in preparing the toner $T_6$ with residual polarization of $0.06\mu C/cm^2$ and without ferroelectric fine powder.

(COMPARATIVE EXAMPLE 1)

In the comparative example 1, the developing apparatus 10*a* according to the first embodiment shown in FIG. 1 is employed as the developing apparatus 10, similarly to the test example 1. The toner $T_5$ with residual polarization described above is employed as the developer 13.

Similarly to the test example 1, in the apparatus 10*a*, d.c. voltage of +5KV is applied from the electric source 42 to the corona discharge device 41 arranged in the developer accommodating section 11*b* to induce electrical discharge. An alternating voltage having a frequency of 300Hz and phases each shifted by peak-to-peak voltage $V_{p-p}$ of 900V is applied from the power source 33 with $\frac{2}{3}\pi$ radians in phase difference each between neighboring phases to each coil 31 to act an electric field curtain force on the toner. The action of the electric field curtain force causes the toner $T_5$ to be electrically charged and be supplied on the surface of the sleeve 12. Then, the toner $T_5$ is transported toward the photosensitive member 20 through the sleeve 12 to develop an image.

(COMPARATIVE EXAMPLE 2)

In the comparative example 2, the developing apparatus 10*b* according to the second embodiment shown in FIG. 4 is employed as the developing apparatus 10, similarly to the test example 4. The toner $T_6$ with residual polarization is employed as the developer 13.

Similarly to the test example 4, in the apparatus 10*b*, the brush 44 arranged in the developer accommodating section 11*b* is rotated at 80 rpm. Then, d.c. voltage of −500V is applied from the bias electric source 45 to the brush 44 to induce electrical discharge between the brush 44 and the contact member 43. An alternating voltage having a frequency of 500 Hz and phases each shifted by peak-to-peak voltage $V_{p-p}$ of 900V is applied from the power source 33 to each coil 31 to act electric field curtain force on the toner. The action of the electric field curtain force causes the toner $T_6$ to be electrically charged and be supplied on the surface of the sleeve 12. Then, the toner $T_6$ is transported toward the photosensitive member 20 through the sleeve 12 to develop an image.

(COMPARATIVE EXAMPLE 3)

In the comparative example 3, two-component system developer comprising the toner $T_5$ 13*a* and the same carrier 13*b* as that employed in the test example 6 is employed as the developer 13.

Figure 9:
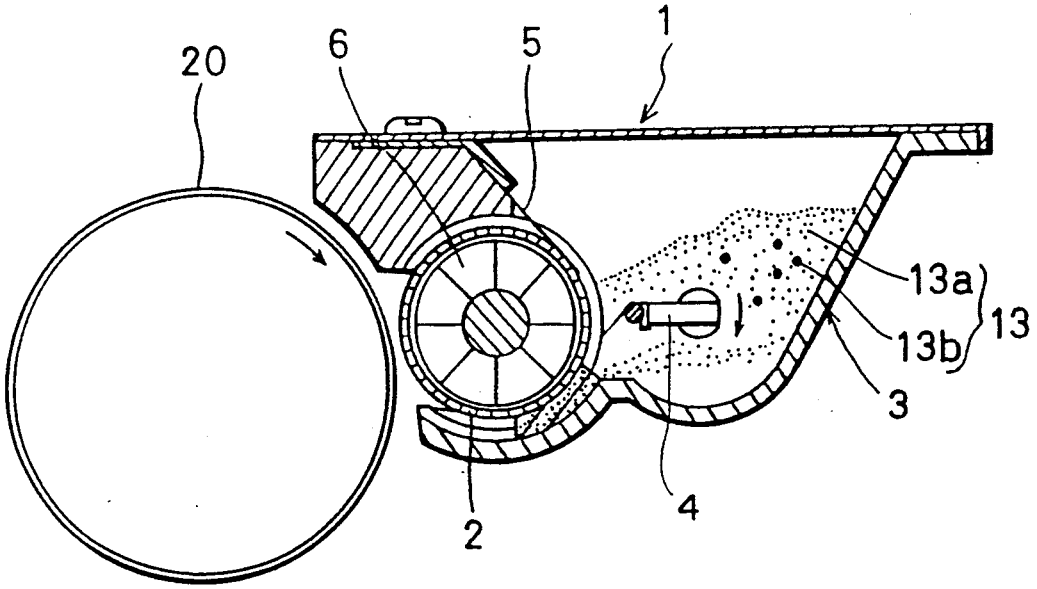
FIG. 9 is a schematically cross sectional view of a developing apparatus according to a comparative example 3 in a state where the apparatus is being employed.

In the comparative example 3, a developing apparatus 1 as shown in FIG. 9 is employed. The two-component system developer 13 is accommodated in a developer accommodating tank 3. An agitator 4 arranged in the tank 3 rotates to stir the developer 13, so that the toner $T_5$ 13*a* contacts with the carrier 13*b* to be electrically charged.

The electrically charged developer 13 is supplied onto the sleeve 2 in which a magnet roller 6 is located. The developer 13 is transported toward the photosensitive member 20 in a magnetic brush state while the amount of the developer 13 supplied to the sleeve 2 is regulated by a blade 5, so that the toner $T_5$ is supplied onto the surface of the member 20.

(COMPARATIVE EXAMPLE 4)

In the comparative example 4, developer comprising the following toner $T_7$ instead of the toner $T_5$ in the comparative example 1 is employed. Another condition is the same as that of the comparative example 1.

The toner $T_7$ is prepared by the same process as the above-described toner $T_3$ except for that 250 parts by weight of PLZT, which has composition ratio of $(Pb_{1-x}$ Lax)/(Zry Tiz)/$O_3$=PLZT (x/y/z)=(0.10/0.62/0.32), with the average grain diameter of 0.8μm is employed instead n of PLZT, which has composition ratio of $(Pb_{1-x}$Lax)/(Zry Tiz)/$O_3$=PLZT (x/y/z)=(0.07/0.65/0.35), in the toner $T_3$, resulting in preparing the toner $T_7$ with residual polarization of 20.8μC/cm².

The measurement of the electric charge amount of the toner supplied onto the sleeve 12 and the evaluation of the quality of an image formed by the toner is performed at 10 and 30 seconds, 30 minutes, and 1.5 hours after the toner is supplied thereon in the test examples 1–7 and the comparative examples 1–4.

The result of the measurement and the evaluation shows in the following Table 1.

TABLE 1

| | Electric charge amount of toner [μC/g] | | | |
|---|---|---|---|---|
| | 10 sec. | 30 sec. | 30 min. | 1.5 hr. |
| Test example 1 | +12.8 | +18.4 | +20.3 | +21.6 |
| Test example 2 | −13.4 | −19.1 | −22.6 | −23.4 |
| Test example 3 | +13.5 | +18.9 | +22.0 | +23.0 |
| Test example 4 | −12.0 | −19.3 | −21.8 | −22.7 |
| Test example 5 | −12.7 | −18.5 | −21.9 | −24.5 |
| Test example 6 | +12.5 | +16.8 | +17.0 | +17.4 |
| Test example 7 | +10.2 | +14.3 | +17.7 | +18.1 |
| Comparative example 1 | +5.1 | +7.6 | +14.2 | +13.6 |
| Comparative example 2 | −4.9 | −7.4 | −12.1 | −11.4 |
| Comparative example 3 | +2.8 | +5.4 | +7.7 | +8.1 |
| Comparative example 4 | −12.4 | −11.8 | −10.4 | +9.8 |

As it is apparent from the result, in the developer apparatus 10 of each embodiment in which the developing device 30 for transporting the developer 13 is arranged, the electric charge of the toner in each test example employed the toner with residual polarization of 0.1–20μC/cm² as the toner in the developer starts at considerably high speed, as compared with each comparative example employed the toner with residual polarization less than 0.1μC/cm². The electric charge amount of the toner in each test example stably within a acceptable range, as compared with the comparative examples.

Each image formed in each test examples has excellent quality without disadvantages such as toner scattering and fog, and the image with the quality is stably obtained for long time without deterioration of toner, as compared with the comparative examples.

Specially, the toner in the comparative example 4 is non-uniformly and electrically charged, and the electric charge starts at high speed therein, but thereafter the value of the electric charge amount does not increase. It seems that the reason is that the toner in the comparative example agglomerates to be insufficiently oscillated by an electric field curtain force.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A developing apparatus comprising an electric field curtain developing device for transporting developer, the developer having toner of residual polarization of 0.1–20μm/cm².

2. A developing apparatus comprising:

an electrostatic latent image holding member for holding an electrostatic latent image;

an accommodating means for accommodating therein developer of residual polarization of 0.1–20μC/cm²;

an electrical field developing means arranged in said accommodating means, the developer being polarized by action of an electric field force developed by said electric field developing means; and a transporting means for transporting the polarized developer to said holding member to developer the electrostatic latent image on said holding member by the developer.

3. A developing apparatus as claimed in claim 2, wherein an unequal alternating electric field is developed by said electric field developing means to apply an electric field curtain force on the developer.

4. A developing apparatus as claimed in claim 3, wherein said electric field developing means comprises at least two electrodes electrically insulated from each other and an applying means for applying an alternating voltage on the two electrodes.

5. A developing apparatus as claimed in claim 4, wherein an alternating voltage with a peak-to-peak voltage of 200V–6KV and a frequency of tens–ten KHz is applied on the electrodes by the applying means.

6. A developing apparatus as claimed in claim 2, wherein the developer comprises ferroelectric powder and organic binder.

7. A developing apparatus as claimed in claim 6, wherein material of the powder is selected from the group consisting of barium titanate, lead titanate, strontium titanate, lithium titanate, potassium titanate, bismuth titanate, calcium titanate, lithium niobate, potassium niobate, sodium niobate, lithium tantalate, lead zirconate, barium zirconate, barium stannate, PZT, PLZ, and PLZT.

8. A developing apparatus as claimed in claim 7, wherein the developer has an average grain diameter of 2–20μm.

9. A developing apparatus as claimed in claim 8, wherein the powder has an average grain diameter of 0.02–5.0μm and the developer comprises 0.1–50 wt % of the powder.

* * * * *